US011030925B1

(12) United States Patent
August et al.

(10) Patent No.: US 11,030,925 B1
(45) Date of Patent: Jun. 8, 2021

(54) KINETIC DISPLAY FOR DEPICTING CHANGES IN ECONOMIC OR OTHER DATA

(71) Applicant: Steve August, Portland, OR (US)

(72) Inventors: Steve August, Portland, OR (US); Jesse Jenkins, Portland, OR (US); Steven O'Toole Dodson, Gresham, OR (US)

(73) Assignee: Steve August, Portland, OR (US)

( * ) Notice: Subject to any disclaimer, the term of this patent is extended or adjusted under 35 U.S.C. 154(b) by 504 days.

(21) Appl. No.: 16/134,240

(22) Filed: Sep. 18, 2018

Related U.S. Application Data

(60) Provisional application No. 62/560,233, filed on Sep. 19, 2017.

(51) Int. Cl.
*G09F 19/08* (2006.01)
*G09F 11/10* (2006.01)

(52) U.S. Cl.
CPC ..... *G09F 19/08* (2013.01); *G09F 11/10* (2013.01)

(58) Field of Classification Search
CPC ..... G09F 19/08; G09F 11/10; G09F 11/02; G09F 11/00
See application file for complete search history.

(56) References Cited

U.S. PATENT DOCUMENTS 2,830,815 A * 4/1958 Hawes ..... A63G 11/00 472/107
5,030,485 A * 7/1991 Meeks ..... G09F 19/08 428/7
5,584,742 A * 12/1996 Chen ..... G09F 19/08 40/414
5,608,386 A * 3/1997 Murphy, III ..... G01D 13/28 340/688
2004/0095255 A1* 5/2004 Namaky ..... G07C 5/0825 340/815.78
2009/0183402 A1* 7/2009 Tsao ..... G09F 19/08 40/423
2013/0185967 A1* 7/2013 Adams ..... G09F 13/02 40/218

* cited by examiner

*Primary Examiner* — Gary C Hoge
(74) *Attorney, Agent, or Firm* — Craig A. Fieschko, Esq.; DeWitt LLP

(57) ABSTRACT

A kinetic display has a base, and an elongated member pivotally attached to the base in the manner of a seesaw. A processor communicates with a data source such as the internet, obtains current values of dynamically changing data (such as the current value of a stock market index), and pivots the elongated member in response to changes in the data. Figurines which symbolize the monitored data, such as a bull and a bear (representing rising and falling stock market values), are respectively provided at opposing ends of the member. By observing the inclination of the elongated member, and/or the relative positions of the figurines thereon, a user can determine the current status of monitored data.

15 Claims, 2 Drawing Sheets

KINETIC DISPLAY FOR DEPICTING CHANGES IN ECONOMIC OR OTHER DATA

CROSS-REFERENCE TO RELATED APPLICATIONS

This application claims priority under 35 USC § 119(e) to U.S. Provisional Patent Application 62/560,233 filed 19 Sep. 2017, the entirety of which is incorporated by reference herein.

FIELD OF THE INVENTION

This document concerns an invention relating generally to devices which amuse and/or provide an ornamental moving display while at the same time providing information regarding one or more variables of interest to observers, such as economic variables (e.g., securities indexes such as the NASDAQ Composite, New York Stock Exchange Composite, Standard & Poor 500, Russell 1000, etc.), variables relating to sporting activities (e.g., sports team scores, rankings, or betting odds), variables relating to political matters (e.g., voting or polling results), or other economic, cultural, and political variables.

BACKGROUND OF THE INVENTION

Many people monitor internet and/or other news sources daily, or even several times per day, to monitor their investments (e.g., stocks, bonds, commodities, currencies, etc.) as the market varies. Many people similarly like to monitor the status of sports teams or athletes (e.g., game outcomes, team/athlete rankings, etc.), political parties or politicians (e.g., voting outcomes, polling results, etc.), and other matters. Obtaining this information can be frustrating, as it may require several steps, as by entering login information and/or indexing through multiple screens); delay, as where the desired information is not immediately announced or displayed; and/or parsing through extraneous information, as where one must "hunt" for the desired information within a large collection of displayed information.

SUMMARY OF THE INVENTION

The invention involves a kinetic display which is intended to at least partially solve the aforementioned problems. To give the reader a basic understanding of some of the advantageous features of the invention, following is a brief summary of an exemplary version of the display, with reference being made to the accompanying drawings (which are briefly reviewed in the following "Brief Description of the Drawings" section of this document) to assist the reader's understanding. Since the following discussion is merely a summary, it should be understood that more details regarding the various versions of the invention may be found in the Detailed Description set forth elsewhere in this document. The claims set forth at the end of this document then define the various versions of the invention in which exclusive rights are secured.

The accompanying FIGS. 1-2 illustrate an exemplary kinetic display 100 which shows the current status of, and/or changes in, economic, cultural, political, and/or other variables. The kinetic display 100 includes an elongated member 102 which pivots with respect to a base 104 in response to a change in a user-selected variable. For example, an increase in the value of a user's securities brokerage account, or in a user-selected stock market index such as the Dow Jones Industrial Average (DJIA), might result in the member's pivoting such that the side with the bull figurine 106A rises and the bear figurine 106B descends (as a bull is traditionally recognized as a symbol of a rising market, whereas a bear symbolizes a falling market). Conversely, a decrease in the value of the user's securities brokerage account or chosen market index might result in the member's pivoting such that the side with the bear figurine 106B rises and the side with the bull figurine 106A descends. The display 100 therefore provides a user with an intuitive and aesthetically attractive means for determining the current status of a desired variable, by merely observing the inclination of the member 102, and/or the relative positions of the figurines 106A and 106B thereon.

Reviewing the kinetic display 100 in greater detail, the elongated member 102 is pivotally attached to a pivot mount 108 extending upwardly from the base 104, with the pivot mount 108 here being defined by a pair of supports between which the elongated member 102 is pivotally connected (here by a spindle 110 extending from the elongated member 102 into bearing holes in the supports 108). The elongated member 102 preferably extends outwardly from the base 104 in opposing directions to terminate in first and second free ends 112A and 112B, i.e., ends which aren't connected to structures which are immobile with respect to the kinetic display 100, or to linkages or other parts that move in a different manner or direction than the upward/downward motion of the elongated member 102. The figurines 106A and 106B are then preferably attached to the free ends 112A and 112B, with the figurine 106A of the first end 112A being different from the figurine 106B of the second end 112B. Most preferably, the first figurine 106A symbolizes matter which is conceptually opposite the matter of the second figurine 106B, such that the rise of one of the figurines and the corresponding descent of the other clearly suggests that one of the states of the variable symbolized by the kinetic display 100 is increasing relative to the opposite state, or is otherwise dominating the opposite state. Preferably, the elongated member 102 is restricted to pivot no more than approximately plus and minus 30 degrees from a horizontal orientation.

The elongated member 102 is pivoted by an electromechanical actuator 114 (FIG. 2), preferably a servomotor, with the actuator 114 pivoting the elongated member 102 with respect to the base 104 in response to data received from a source external to the kinetic display 100 (preferably from the internet). The kinetic display 100 preferably includes a processor 116 (e.g., a microcontroller) which receives the data from the internet or other external source, and which drives the actuator 114 to pivot the elongated member 102 in response to the data. The processor 116 preferably continuously or occasionally receives the data from a wireless receiver 118 (e.g., a Bluetooth, ZigBee, WiFi, BLE, WiMax, 3G, 4G, or other wireless receiver) in communication with the internet.

In the illustrated kinetic display 100, the elongated member 102 is attached to a curved rack 120 which bears an array of teeth 122. The actuator 114 (FIG. 2) bears a pinion 124 which drives the rack 120, and thereby pivots the elongated member 102. The rack 120 may bear an array of indicia 126 spaced along its curve, with the indicia 126 quantifying the data to be illustrated by the kinetic display 100; for example, the indicia 126 may indicate changes of plus and minus 10%, 20%, 30%, etc. about some datum (which might be indicated by "0," "MARKET OPEN," or other indicia). The kinetic display 100 may also include an indicator which draws attention to the indicium communicating the data value currently being exhibited by the kinetic display 100, such as a window 128 which frames the current indicium and/or a needle 130 which points to the current indicium, wherein one of the indicator and the array travels along the other when the member 102 pivots with respect to the base 104. The illustrated kinetic display 100 includes both such indicators in the form of a window 128 having a needle 130 therein. A magnifying glass 132 (e.g., a convex lens) can be provided on the base 104, here within the window 128 and adjacent the indicia-bearing rack 120, to increase the readability of, and/or further draw attention to, the current indicium.

Further potential advantages, features, and objectives of the invention will be apparent from the remainder of this document in conjunction with the associated drawings.

DETAILED DESCRIPTION OF EXEMPLARY VERSIONS OF THE INVENTION

Figure 1:
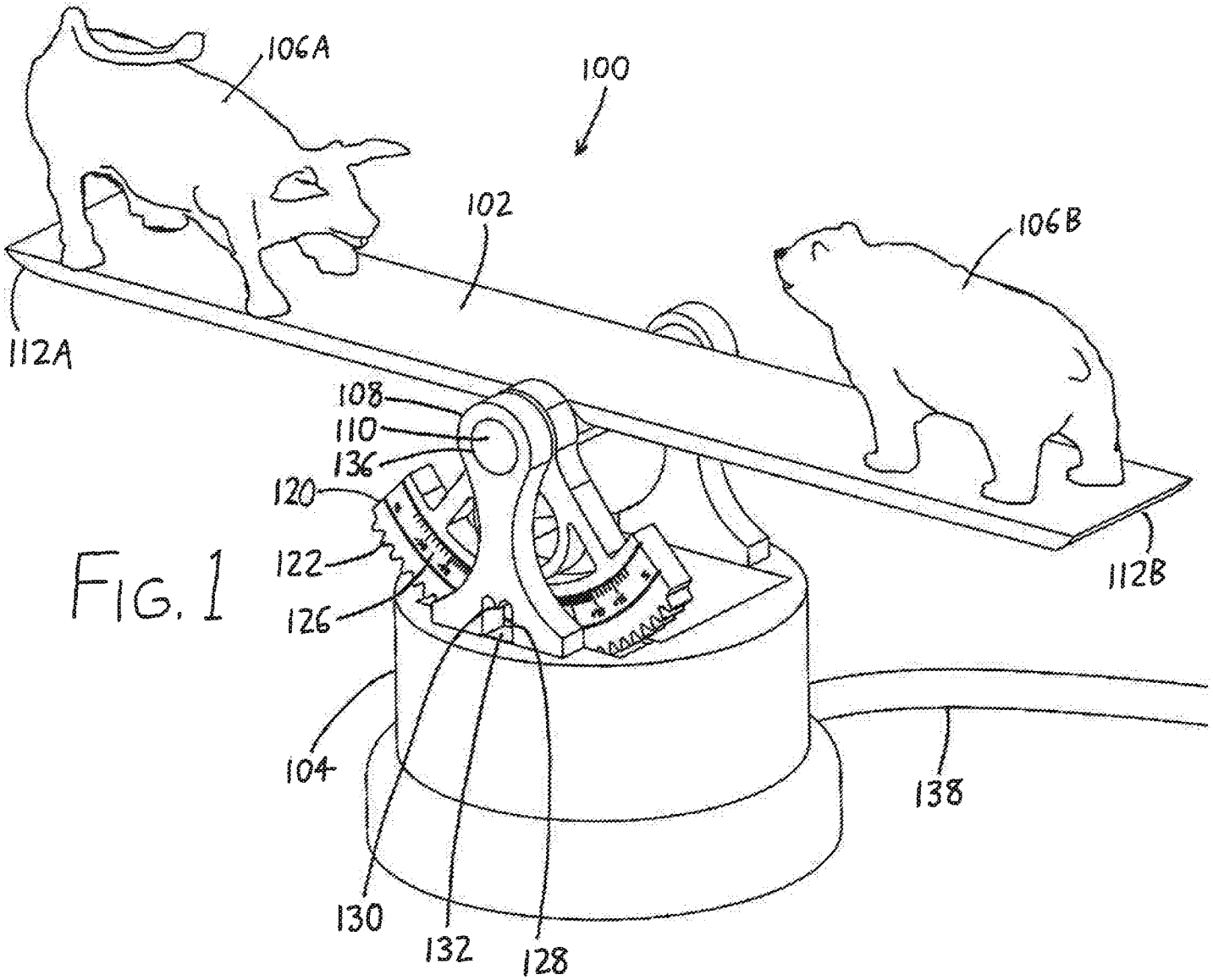
FIG. 1 is a perspective view of an exemplary version of the kinetic display, wherein the display 100 is specially configured to illustrate changes in the value of a security, securities account, or securities market via a rising bull figurine 106A (or falling bear figurine 106B), indicating an increase in value, or via a rising bear figurine 106B (or falling bull figurine 106A), indicating a decrease in value.
Figure 2:
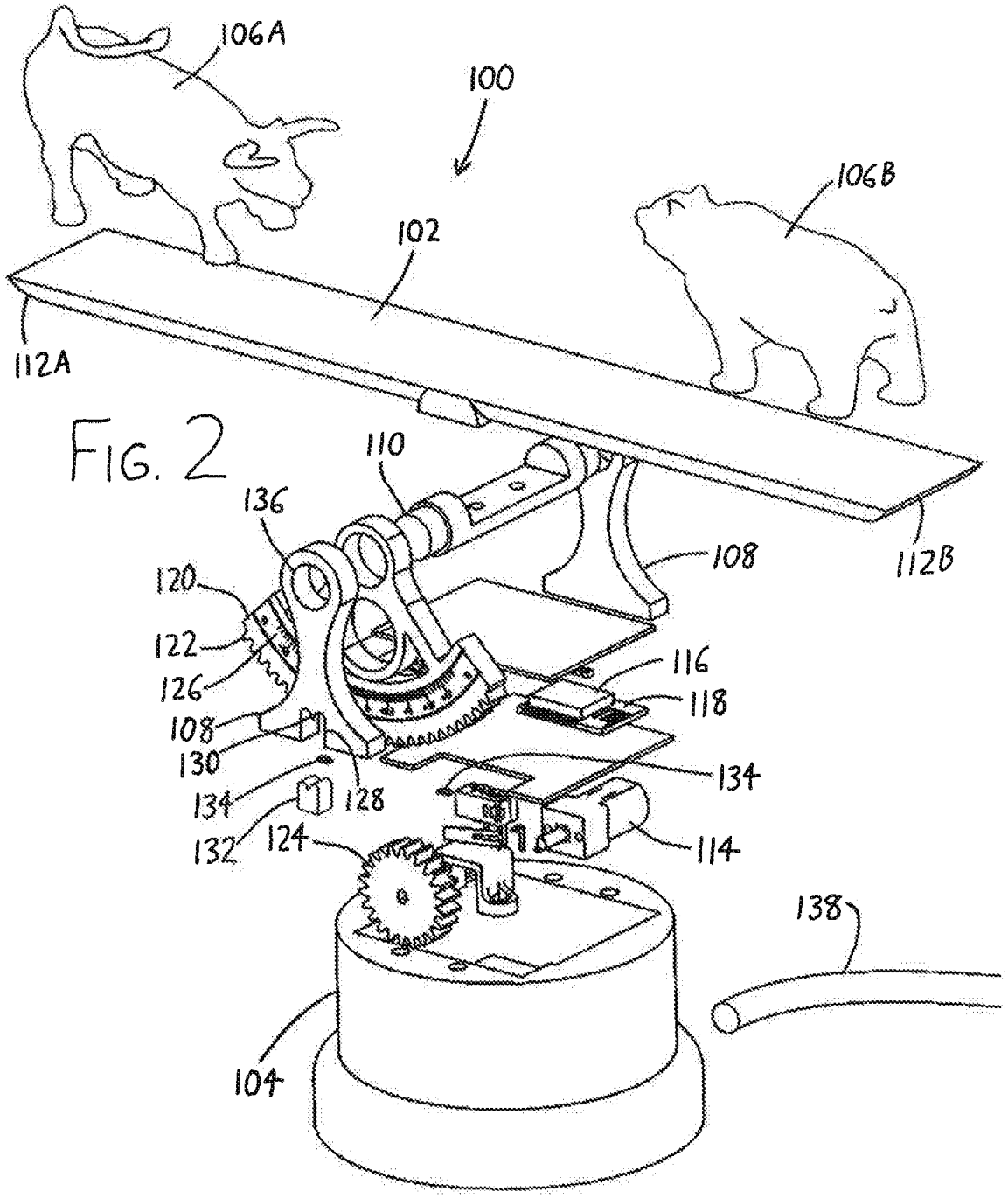
FIG. 2 is an exploded (disassembled) view of the kinetic display 100 of FIG. 1.

Expanding on the discussion above, the kinetic display 100 of FIG. 1-2 occasionally or continuously obtains stock market data (e.g., the Dow Jones Industrial Average, or DJIA), and then dynamically changes the position of the elongated member 102 and its figurines 106A and 106B according to changes in the data. As examples, an increase in the DJIA versus the DJIA's opening value for the day leads to an increase in the height of the bull figurine 106A relative to the height of the bear figurine 106B, and a decrease in the DJIA versus the DJIA's opening value for the day leads to an increase in the height of the bear figurine 106B relative to the height of the bull figurine 106A.

As noted previously, the exemplary kinetic display 100 includes a base 104; supports 108 rising from the base 104, and defining a pivot mount to which the elongated member 102 is pivotally mounted; an arcuate rack 120 affixed with respect to the elongated member 102 and displaying an array of indicia 126 (e.g., numbers) reflecting the degree of change in the data communicated by the display 100; a pinion 124 engaging the rack 120; an electromechanical actuator 114 driving the pinion 124; and a processor 116 driving the actuator 114, and thereby pivoting the elongated member 102 in response to changes in the data communicated by the display 100. The processor 116 preferably receives data from a receiver 118 provided in the base 104, and which occasionally or continuously connects to the internet via wireless communications, though a wired receiver (e.g., an Ethernet or USB port) might also or alternatively be used. In the exemplary kinetic display 100 depicted in the drawings, the processor 116 is integrated with the receiver 118 (i.e., it takes the form of a microcontroller with built-in wireless communications ability). Preferably, the processor 116 is programmed with software/firmware which connects it in communication with one or more data sources, such as remote servers and/or Application Program Interfaces (APIs), to retrieve the data used to move the elongated member 102. The processor 116 receives the data from the data source and sends actuation signals to the actuator 114 to reflect the current state of the data. The kinetic display 100 may receive a signal from a user (e.g., from a manual reset button) to return the elongated member 102 to a horizontal datum orientation, for example, to calibrate the elongated member 102 to a starting value of the DJIA against which changes are measured. Alternatively or additionally, the processor's software/firmware may automatically reset the elongated member 102 to the horizontal datum orientation at a particular time (e.g., at the day's opening of the market), after a particular interval, or if a predetermined triggering event occurs. The elongated member 102 may thereafter move from the horizontal datum orientation in accordance with changes in the monitored data from the datum value at the time of reset.

In the illustrated preferred version of the kinetic display 100, the first time a user powers up the display 100, the user wirelessly connects to the display 100 (e.g., via a computer or mobile device app) to configure the display's wireless communications (e.g., the chosen Wi-Fi network) and choose the data to be communicated by the display 100. For example, a user may choose to monitor securities indexes such as the DJIA, NASDAQ Composite, New York Stock Exchange Composite, Standard & Poor 500, Standard & Poor Aggregate Bond Index, Russell 1000, etc. Alternatively, a user might choose to monitor the value of his/her brokerage or other account, the price of a particular security, commodities prices and indexes, economic activity levels and indexes, economic confidence levels and indexes, currency values and indexes, or cryptocurrency values and indexes.

The base 104 of the exemplary display 100 preferably has a weight and configuration such that it resists tipping, and is sized such that it might prominently display information identifying the data communicated by the display 100, a company logo (or other brands or advertising), a personalized message (as via engraving), or the like. The display 100 is therefore particularly suitable as a promotional or other gift from a broker or investment advisor to a client. However, the base 104 can assume a variety of forms which differ significantly from the one depicted; for example, it might assume the form of a wall-mountable plate/plaque to which the elongated member 102 is pivotally affixed. LED or other lamps 134 (FIG. 2) on the base 104 or elsewhere may illuminate the indicia 126 and/or communicate the operational status of the display 100. The pivot associated with the elongated member 102 may take the illustrated form, wherein a spindle 110 attached to the elongated member 102 is pivotally fit in a bearing hole 136 defined in the opposing pivot mount supports 108, or forms providing equivalent action (for example, spindles/posts extending from the supports may be received in bearing holes or downwardly-facing channels on opposing sides of the elongated member). While the depicted display 100 is provided in the form of a small tabletop sculpture, displays may be differently sized, e.g., as a large outdoor installation.

The actuator 114 may be (for example) a stepping motor, brush motor, servomotor, solenoid, magnetic actuator, piezometric actuator, or other mechanism configured to receive motion commands from the processor 116. In the exemplary depicted version of the kinetic display 100, the actuator 114 uses the pinion 124 to actuate the rack 120, which is attached to the spindle 110 upon which the center of the elongated member 102 rests. Thus, rotational movement of the pinion 124 moves each side of the elongated member 102 up or down to reflect changes in the monitored data. The change may be directly proportional to the change in the data (e.g., a specified percentage change in the DJIA leads to a proportionate change in the angle of the elongated member 102), or the change in the orientation of the elongated member angle may have a logarithmic, exponential, or other relationship to the change in the data. The indicia 126 on the rack 120 might numerically depict the percentage change in the DJIA, while the position of the elongated member 102 provides a visual and intuitive depiction of the change.

The processor 116 may be a microcontroller, an application specific integrated circuit (ASIC), or other programmed or programmable device. The processor 116, receiver 118, actuator 114, lamps 134, and/or any other electronic components of the display 100 may rely on standard mains power (i.e., by plugging the depicted power cable 138 into a standard outlet) and/or on battery power. Other power sources (e.g., onboard solar cells, a generator with a human-actuated crank lever, etc.) could also or alternatively be used. The display 100 preferably includes a battery to supply power when power is otherwise unavailable, and/or for storage of intermittently-supplied power (e.g., where solar or generator power is supplied).

Figurines can be adapted to symbolize different types of monitored data: a bull and a bear for stock markets, currency symbols for currencies or cryptocurrencies, party symbols for political parties or caricatures/busts for political candidates, team mascots or logos for sports teams, or any other figurines related to the data chosen for monitoring by the user. Figurines may be removable and replaceable with different figurines; for example, the bull and bear figurines 106A and 106B of the depicted display 100 might be replaced with team mascots, and the data source might be reconfigured so that the display 100 reflects the results of sports game scores or rankings involving the teams. Other versions of the display 100 may use political polling or election results, meteorological variables, or any other dynamically changing data.

The elongated member 102 need not be formed as a straight prismatic beam, nor need it have equal lengths extending in opposite directions. As an example, the elongated member 102 might be fashioned to resemble a fishing pole or gun, and may be cantilevered from a pivot located on a support 108 shaped to resemble a fisherman or hunter, such that the fisherman or hunter appears to be holding the fishing pole or gun (the elongated member). The fishing pole or gun might then pivot upwardly or downwardly in dependence on fishing/hunting conditions received from the data source, indicating whether current (or at least last-reported) fishing/hunting conditions are favorable. As another example, the elongated member 102 might be fashioned to represent a surfboard, sailboat, or the like, and which is situated atop or adjacent a support 108 resembling the surface of a body of water. The nose of the watercraft might then tip upwardly from the water if water and/or wind conditions are favorable for surfing or sailing, or tip downwardly into the water if conditions are unfavorable.

Throughout this document, the term "figurine" should be regarded as encompassing not only three-dimensional representations of concepts or real-world matter, but also two-dimensional representations (e.g., photos, images, etc.). The term "member" should be regarded as encompassing not only rectangular prisms, but also other elongated shapes, whether rectilinear or otherwise, which allow a viewer to visually discern a change in their position when moved.

When one part is said to be "fixed" to another part, this indicates that the parts are attached in immovable relationship to each other (either directly or via an intervening component), whereas the term "attached" more broadly indicates that the parts may be somehow connected as a unit (either directly or via an intervening component), though one part may move with respect to the other, or that the parts may be fixed.

It should be understood that the versions of the invention described above are merely exemplary, and the invention is not intended to be limited to these versions. Rather, the scope of rights to the invention is limited only by the claims set out below, and the invention encompasses all different versions that fall literally or equivalently within the scope of these claims.

What is claimed is:

1. A kinetic display including:
- a. a base having a pivot mount thereon,
- b. an elongated member:
  - (1) pivotally attached to, and extending outwardly from, the pivot mount,
  - (2) extending outwardly from the base in opposite directions to opposing first and second ends,
  - (3) wherein:
    - i. each end of the member has a figurine attached to the end, and
    - ii. the figurine of the first end differs from the figurine of the second end,
- c. an electromechanical actuator configured to pivot the member about the pivot mount with respect to the base in response to data received from a source external to the kinetic display.

2. The kinetic display of claim 1 wherein the member is restricted to pivot no more than 30 degrees from a horizontal orientation.

3. The kinetic display of claim 1 further including a processor configured to:
- a. receive the data from the source external to the kinetic display, and
- b. drive the actuator to pivot the member with respect to the base in response to the received data.

4. The kinetic display of claim 1 further including:
- a. a receiver configured to at least periodically wirelessly receive the data from the source external to the kinetic display, and
- b. a processor configured to:
  - (1) receive the data from the receiver, and
  - (2) drive the actuator to pivot the member with respect to the base in response to the received data.

5. The kinetic display of claim 1 further including:
- a. a curved rack attached to the member, the rack bearing an array of driven teeth,
- b. a pinion attached to the electromechanical actuator, the pinion having driving teeth meshing with the driven teeth.

6. The kinetic display of claim 5 wherein the rack bears an array of indicia spaced therealong.

7. The kinetic display of claim 6 further including at least one of:
- a. a window defined within the pivot mount, wherein the indicia travel past the window when the member pivots with respect to the base; and
- b. a needle situated on the pivot mount, wherein the indicia travel past the needle when the member pivots with respect to the base.

8. The kinetic display of claim 5:
- a. further including a convex lens attached to the base, and
- b. wherein the rack travels adjacent the lens as the member pivots about the pivot mount.

9. The kinetic display of claim 1:

a. bearing an array of indicia spaced along an elongated path, b. further including an indicator defined by least one of:

(1) a window, and (2) a needle, wherein one of the indicator and the array travels adjacent the other when the member pivots with respect to the base.

10. The kinetic display of claim 1 wherein the pivot mount includes a pair of supports:

a. extending from the base, and b. having the member pivotally connected therebetween.

11. The kinetic display of claim 1 wherein the member extends outwardly from the base to terminate in a free end.

12. The kinetic display of claim 11 further including a figurine attached to the free end.

13. The kinetic display of claim 1 wherein:

a. the first end bears a figurine of a bull, and b. the second end bears a figurine of a bear.

14. The kinetic display of claim 1 wherein the data encodes the value of one or more of:

a. a brokerage account;

b. a securities index;

c. a currency value index;

d. a commodities index;

e. an economic activity index; and f. an economic confidence index;

g. a political polling result;

h. a sport game score;

i. a sport ranking; and j. a meteorological variable.

15. A kinetic display including:

a. a base having a pivot mount extending upwardly therefrom, b. an elongated member:

(1) pivotally attached to the pivot mount, and (2) extending in opposite directions outwardly from the pivot mount to opposing first and second ends, c. a first figurine attached to the first end, d. a second figurine attached to the second end, e. an electromechanical actuator configured to pivot the member about the pivot mount, whereby one of the first and second ends rises when then other of the first and second ends descends, d. a processor configured to:

(1) receive data from a source external to the kinetic display, and (2) drive the actuator to pivot the member with respect to the base in response to the data.

* * * * *